US009695808B2

(12) United States Patent
Giessbach et al.

(10) Patent No.: US 9,695,808 B2
(45) Date of Patent: Jul. 4, 2017

(54) POSITIVE DISPLACEMENT PUMP AND OPERATING METHOD THEREOF

(71) Applicant: MHWIRTH GMBH, Erkelenz (DE)

(72) Inventors: Alfred Giessbach, Erkelenz (DE); Norbert Jaeger, Heinsberg (DE)

(73) Assignee: MHWIRTH GMBH, Erkelenz (DE)

( * ) Notice: Subject to any disclaimer, the term of this patent is extended or adjusted under 35 U.S.C. 154(b) by 337 days.

(21) Appl. No.: 14/347,243

(22) PCT Filed: Sep. 28, 2012

(86) PCT No.: PCT/EP2012/069160
§ 371 (c)(1),
(2) Date: Mar. 26, 2014

(87) PCT Pub. No.: WO2013/045598
PCT Pub. Date: Apr. 4, 2013

(65) Prior Publication Data

US 2014/0248160 A1 Sep. 4, 2014

(30) Foreign Application Priority Data

Sep. 30, 2011 (DE) ..... 10 2011 054 073
Sep. 30, 2011 (DE) ..... 10 2011 054 074

(51) Int. Cl.

| | |
|---|---|
| ***F04B 43/02*** | (2006.01) |
| ***F04B 27/08*** | (2006.01) |
| ***F04B 9/109*** | (2006.01) |
| ***F04B 11/00*** | (2006.01) |
| ***F04B 43/06*** | (2006.01) |

(52) U.S. Cl.
CPC ..... *F04B 27/08* (2013.01); *F04B 9/1095* (2013.01); *F04B 11/005* (2013.01); *F04B 43/06* (2013.01)

(58) Field of Classification Search
CPC ..... F04B 43/067; F04B 43/06; F04B 11/005; F04B 17/00; F04B 17/006; F04B 17/03; F04B 1/04; F04B 27/08; F04B 43/107; F04B 53/06; F04B 53/08; F04B 9/02; F04B 9/1095; F04B 1/02; F04B 33/005;
(Continued)

(56) References Cited

U.S. PATENT DOCUMENTS

D30,636 S * 4/1899 Kimes ..... D15/7
2,778,315 A 1/1957 Crookston et al.
(Continued)

FOREIGN PATENT DOCUMENTS

AU 198169893 A1 11/1981
DE 946 769 C 8/1956
(Continued)

OTHER PUBLICATIONS

Manning et al (Oilfield Processing of Petroleum: Crude Oil, 1995, PennWell Books, vol. 2, p. 183 ).*
(Continued)

*Primary Examiner* — Charles Freay
*Assistant Examiner* — Thomas Cash
(74) *Attorney, Agent, or Firm* — Norman B. Thot

(57) ABSTRACT

A positive displacement pump includes a drive unit and a pump unit. The pump unit comprises a plurality of working chambers, a plurality of displacement elements, and at least three cylinders. The pump unit is configured to be double-acting.

12 Claims, 7 Drawing Sheets

(58) Field of Classification Search
CPC ..... F04B 9/042; F04B 11/0066; F04B 23/06; F04B 19/022; F02B 3/06; F02M 59/14
USPC ..... 417/521
See application file for complete search history.

(56) References Cited

U.S. PATENT DOCUMENTS

| | | | | |
|---|---|---|---|---|
| 3,847,511 | A | 11/1974 | Cole | |
| 4,008,009 | A | 2/1977 | Kovacs et al. | |
| 4,188,170 | A | 2/1980 | Ito | |
| 4,406,595 | A | 9/1983 | Robertson et al. | |
| 4,427,350 | A | 1/1984 | O'Hare | |
| 4,963,075 | A * | 10/1990 | Albertson | F04B 43/026 417/221 |
| 2002/0168273 | A1 | 11/2002 | Olson | |
| 2010/0014996 | A1 | 1/2010 | Wilmsen | |
| 2011/0135514 | A1 | 6/2011 | Huhnke et al. | |
| 2012/0011998 | A1 | 1/2012 | Johansson et al. | |

FOREIGN PATENT DOCUMENTS

| | | | |
|---|---|---|---|
| DE | 17 63 709 | U | 3/1958 |
| DE | 10 61 186 | B | 7/1959 |
| DE | 11 07 512 | B | 5/1961 |
| DE | 12 54 968 | B | 11/1967 |
| DE | 28 55 167 | A1 | 7/1980 |
| DE | 37 10 013 | A1 | 10/1987 |
| DE | 41 22 538 | A1 | 1/1993 |
| DE | 11 2008 000 123 | T5 | 11/2009 |
| EP | 0 484 575 | A1 | 5/1992 |
| EP | 2 154 371 | A1 | 2/2010 |
| GB | 586862 | A | 4/1947 |
| WO | WO 2010/098707 | A1 | 9/2010 |

OTHER PUBLICATIONS

Goulds Pumps, Inc. A catalogue of pumps and hydraulic machinery for every sevice, 1900 pp. 196-201.*

* cited by examiner

Prior Art for Large Volumes

POSITIVE DISPLACEMENT PUMP AND OPERATING METHOD THEREOF

CROSS REFERENCE TO PRIOR APPLICATIONS

This application is a U.S. National Phase application under 35 U.S.C. §371 of International Application No. PCT/EP2012/069160, filed on Sep. 28, 2012 and which claims benefit to German Patent Application No. 10 2011 054 073.3, filed on Sep. 30, 2011, and to German Patent Application No. 10 2011 054 074.1, filed on Sep. 30, 2011. The International Application was published in German on Apr. 4, 2013 as WO 2013/045598 A2 under PCT Article 21(2).

FIELD

The present invention relates to a positive displacement pump comprising a drive unit and a pump unit, and an operating method thereof. The pump unit has a plurality of working chambers, a plurality of displacement elements, and frequently at least three cylinders. Such positive displacement pumps have previously been described. FIGS. 1 and 2 show, for example, a positive displacement pump made by Aker Wirth GmbH. Such positive displacement pumps are used as flushing pumps for drilling fluid and as so-called slurry pumps, i.e., for transporting solids found in liquid. They are also called thick matter pumps. Thick matters are mixtures of liquid and solid components. Such pumps generate a pressure of up to 500 bar, have a capacity of up to 300 l per minute, and a power frequently exceeding 700 kW.

SUMMARY

An aspect of the present invention is to provide a pump with an improved lifespan and an operating method therefor while at the same time maintaining and/or expanding the advantages of such a pump with at least three cylinders.

In an embodiment, the present invention provides a positive displacement pump which includes a drive unit and a pump unit. The pump unit comprises a plurality of working chambers, a plurality of displacement elements, and at least three cylinders. The pump unit is configured to be double-acting.

BRIEF DESCRIPTION OF THE DRAWINGS

The present invention is described in greater detail below on the basis of embodiments and of the drawings in which.

DETAILED DESCRIPTION

In an embodiment of the present invention, the positive displacement pump can, for example, have a drive unit and a pump unit. The pump unit comprises a plurality of working chambers and a plurality of displacement elements. The pump unit comprises at least three cylinders. It is double-acting, i.e., two working chambers are thus provided per cylinder. At least six working chambers are thus provided overall.

Figure 1:
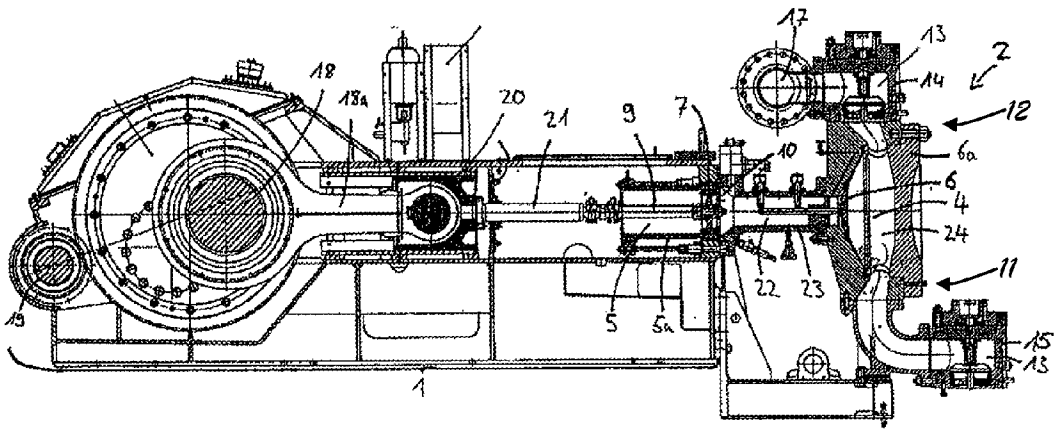
Fig. 1 (Prior Art)
FIG. 1 shows a cross-sectional depiction of a conventional triple-acting triplex pump described in the prior art.
Figure 2:
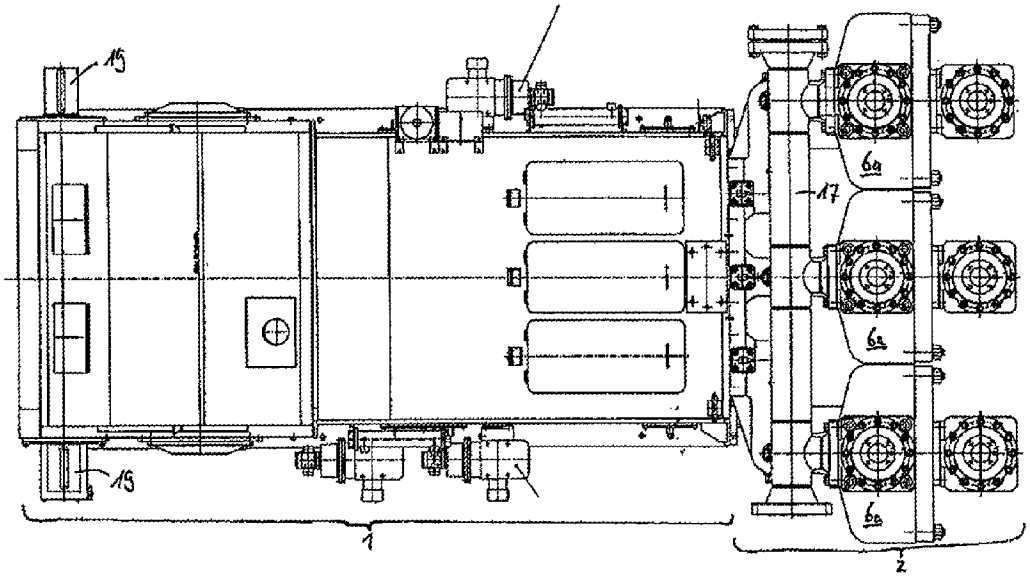
Fig. 2 (Prior Art)
FIG. 2 shows a top view of the pump shown in FIG. 1.

In an embodiment of the present invention, at least three cylinders can, for example, be provided. The pump is a triplex pump (also called a triplet pump) which is double-acting. The advantages of a triplex pump are thus combined with the advantages of a double-acting pump. The positive displacement pump with three cylinders (triplex) shown in FIGS. 1 and 2 is single-acting. Under normal operating conditions, their displacement elements (diaphragms) perform a displacement stroke, i.e., they move from left to right (relative to FIG. 1). The operating pressure puts significant stress on the entire positive displacement pump. This is followed by a suction stroke, i.e., the diaphragms move from right to left (relative to FIG. 1) which puts no or merely little stress on the pump. During the piston's movement to the right (relative to FIG. 1), the pump is exposed to great stress while the piston's movement to the left (relative to FIG. 1) causes no or only a little stress. Due to the switch from single-acting to double-acting, the phases with little or no stress disappear. It has surprisingly become evident that, at the same pump capacity, a distinct increase of the expected lifespan can nevertheless be achieved. It has furthermore surprisingly become evident that the additional cost inherently associated with double action can thus be overcompensated.

In an embodiment of the present invention, the displacement elements can, for example, be diaphragms. They can, for example, be actuated by means of pistons. The positive displacement pump according to the present invention is thus a piston diaphragm pump. The diaphragm separates the medium to be pumped from the drive. This separating diaphragm shields the drive from damaging effects of the medium to be pumped. The medium to be pumped is also shielded from damaging effects of the drive. The oscillating movement of the piston can, for example, be transmitted to the diaphragms using a working fluid or transmission fluid. The working fluid can be water with a water-soluble mineral additive or a hydraulic oil. Due to the constant volume of the working fluid between piston and diaphragm, the movement of the piston directly causes a deflection of the diaphragm and thus generates suction and pressure pulses. Exactly one piston can, for example, be provided in each cylinder.

In an embodiment of the present invention, the pump can, for example, be a thick matter pump. It thus pumps mixtures of liquid and solid components which can be sludge during excavations or the like. Such piston diaphragm pumps are designed for continuous operation and must reliably function as trouble-free as possible over long periods of time, even years, since the replacement of a defective piston diaphragm pump, due to its size, is consistently associated with significant expenditure of labor and time.

Damage to the diaphragm of these piston diaphragm pumps can furthermore have particularly dire consequences. In the event of damage to the diaphragm, the working liquid enters the diaphragm chamber or the working chamber and mixes with the medium to be pumped, resulting in intensive cleaning. The medium to be pumped additionally mixes with the working fluid which can contaminate the entire pump and damage the drive piston.

Such piston diaphragm pumps are known from Aker Wirth GmbH, Erkelenz, Germany, under the designations "DPM" and "TPM." They are designed as duplex pumps with two double-acting pistons or as triplex pumps with three single-acting pistons. The cylinders are always arranged horizontally, and the pistons therefore perform their oscillating movement along a horizontally oriented axis. The diaphragms connected through the working liquid with the displacement of the correspondingly associated cylinder are always arranged perpendicularly. "Perpendicular arrangement" means that the action plane defined by the diaphragm extends perpendicularly. It is defined by the edge clamped in the diaphragm housing for a planar diaphragm in a non-deflected state.

In such diaphragm pumps, the inlet 11 is consistently located on the underside, and the outlet is 12 located on the upper side, which allows for air in the diaphragm chamber to escape upwardly.

In an embodiment of the present invention, the drive unit can, for example, be provided the same way it is provided for in a conventional single-acting triplex pump. FIGS. 1 and 2 show that a driveshaft is provided which is operated by a motor (not shown) and transmits its torque to a crankshaft using meshing toothed wheels, with connecting rods arranged on the crankshaft. All connecting rods are arranged on a single crankshaft and act in the same direction. They transmit their movement using a crosshead, i.e., to crosshead rods which are arranged relatively close to one another and run parallel to one another. These crosshead rods act together with the piston rods. The cylinders run closely parallel to one another. A drive unit is thus used which is tried, tested and compact. In addition to saving development costs, the use of tried and tested elements is of particular importance since the typical fields of application of the positive displacement pump according to the present invention require extreme reliability. The cylinders can, for example, be arranged in a lying position, i.e., horizontally.

In an embodiment of the present invention, the speed of the positive displacement pump according to the present invention can, for example, be reduced with respect to a conventional single-acting triplex pump. This can, for example, be achieved with a slower running of the drive motor. Due to the fundamentally greater capacity of the double-acting pump unit, this measure can be taken at a consistent volume flow when compared to a conventional single-acting triplex pump.

In an embodiment of the present invention, the size of the piston surface can, for example, be reduced compared to a conventional single-acting triplex pump. Since the pump unit is double-acting, it pumps twice as large a volume flow of medium to be pumped at unchanged stroke volume and unchanged speed than a single-acting pump unit. In order to achieve a volume flow comparable to a conventional single-acting triplex pump, the stroke volume, alternatively or additionally to a reduction of the speed, can be reduced by way of reducing the cross-section of the piston surfaces. This results in a decrease of the rod force (piston rod and/or crosshead rod and/or connecting rod). Even though said force, unlike in a single-acting pump, acts with the same or comparable power in both directions of movement of the piston, it has become apparent that this results in an increase of the expected lifespan of critical components such as bearings. It has furthermore become apparent that the increase in lifespan is surprisingly high.

For the embodiment as a diaphragm pump, smaller diaphragms can be used which can be more cost-efficient and durable. As already mentioned above, the reduced rod force results in lower bearing stress. Slower speed increases the lifespan of the pump unit, particularly that of the diaphragms. Compared to a double-acting duplex pump, i.e., a pump with two instead of three cylinders, the structure of a triplex pump provides for less pulsation. Lower rod forces are furthermore achieved since the capacity is apportioned to three instead of two pump columns.

In an embodiment of the present invention, the diaphragms can, for example, be tilted at an angle of 1° to 90° relative to the perpendicular line. Unlike a conventional single-acting triplex pump, the diaphragms are thus not perpendicular. The position of the diaphragms relates to their neutral middle position.

In an embodiment of the present invention, the diaphragms can, for example, be arranged higher than the cylinders. Unlike a conventional single-acting triplex pump, the diaphragms are thus "folded" upward.

In an embodiment of the present invention, the pump can, for example, have a power of 700 kW. The advantages of the present invention become particularly evident at such high power and great forces associated therewith.

The present invention also relates to a pump unit of a pump according to the present invention.

An aspect of the present invention is to provide an operating method for a piston diaphragm pump and a piston diaphragm pump operating in accordance with the operating method, the lifespan of which is increased at equal capacity as in the prior art, or the capacity of which is increased at consistent lifespan, regardless of whether it is a single- or double-acting pump and regardless of the number of cylinders.

In an embodiment, the present invention provides an operating method for a positive displacement pump provided as a piston diaphragm pump which includes providing a positive displacement pump configured to be double-acting. The positive displacement pump comprises a drive unit and a pump unit. The pump unit comprises a plurality of working chambers, at least three cylinders which each comprise a piston, a plurality of displacement elements comprising diaphragms which each have a first side and a second side and are configured to be actuated by the pistons, and a diaphragm chamber bounded by the second side. A working liquid is provided on the first side of each of the diaphragms. A diaphragm stroke is provided via the working liquid. A medium to be pumped is conducted through the diaphragm chamber via the diaphragm stroke. The diaphragm stroke is provided at a diaphragm position different from a vertical position of the diaphragm.

In the operating method according to the present invention, the diaphragm stroke is caused at a diaphragm position different from a perpendicular position of the diaphragm. It has surprisingly become evident that this technically easily implemented measure significantly increases the lifespan of the diaphragm. This surprising effect can possibly be attributed to the fact that in the operating method according to the prior art, which has a perpendicularly aligned diaphragm, air pockets accumulate, for example, near the inlet 11 in the lower region of the diaphragm, which causes asymmetric stress on the diaphragm during thrust displacement which can lead to accelerated aging and/or fatigue of the diaphragm material, particularly near the clamped edges. In order to avoid a premature diaphragm defect due to material overload, the diaphragms in piston diaphragm pumps according to the prior art are consistently displaced by no more than seventy percent of the maximum diaphragm stroke. It has surprisingly become evident that with the operating method according to the present invention, it is possible to increase the stroke up to ninety percent of the maximum displacement while maintaining the expected diaphragm lifespan without the requirement of further elaborate technical measures.

A particularly large lifespan extension or performance increase can be achieved if the diaphragm stroke is, for example, caused at a diaphragm position different from the perpendicular line by 45° to 90°.

In an embodiment of the present invention, the tilt of the diaphragm stroke from the perpendicular line can, for example, be approximately 70° since in such a case, at otherwise conventional dimensions and designs of a piston diaphragm pump, gas (usually air), which may be present in the working liquid, accumulates at the highest edge region of the diaphragm and can be easily released through a venting valve arranged at such a point.

The piston diaphragm pump according to the present invention is characterized in that the diaphragm is arranged at a position different from the perpendicular line, for example, by 45° to 90°, or for example, by approximately 70°.

The piston diaphragm pump according to the present invention (as is common in piston diaphragm pumps provided for pumping sludge during excavations) is arranged so that the cylinder (or in case of multiple pumps) or cylinders with its (their) longitudinal axis (axes) is (are) arranged approximately horizontally. Drive and piston/cylinder units as in the prior art can therefore be used. The working volume can, for example, be formed to some extent by a channel extending upward at an angle from the cylinder.

In an embodiment of the present invention, the channel can, for example, be designed to be approximately straight and a flange aligned approximately perpendicular to the longitudinal axis of the channel can be provided on the channel housing forming the channel, a diaphragm housing for receiving the diaphragm being attached to the flange. The same components as in the prior art can thus again be used as a diaphragm and a diaphragm housing, thus achieving a substantial improvement of a piston diaphragm pump without requiring design-related additional costs.

The diaphragm can, for example, be designed to be approximately circular and to have an edge which is clamped in the diaphragm housing approximately in one plane, wherein the plane is arranged in a position different from a perpendicular position, for example, by 45° to 90°, or, for example, at an angle so that the highest point of the working volume is formed on a lateral edge region. An approximately perpendicularly upward facing venting valve provided in a piston diaphragm pump according to the prior art can furthermore be used for ventilation of the working volume.

The present invention shall be further described using an embodiment shown in the drawings.

FIG. 1 shows the conventional single-acting triplex pump known from the prior art having a drive unit 1 and a pump unit 2. The drive unit 1 comprises a driveshaft 19 which is put into rotation by a motor, for example an electric motor (not shown). On the drive shaft 19, at least one, merely implied, toothed wheel is arranged which meshes with at least one significantly larger, merely implied, toothed wheel of the crankshaft 18. The driveshaft 19 protrudes on both sides from the housing of the drive unit 1 (FIG. 2). Three connecting rods 18*a* are arranged relatively close to one another on the crankshaft 17. The connecting rods 18*a* are mounted on the crankshaft 18 by means of a big end bearing which is designed as roller bearing. Each of the connecting rods 18*a* transmits its movement by means of a crosshead 20 to a crosshead rod 21 which transitions into a piston rod 9. The crosshead bearing is also a roller bearing. The crosshead 20 also comprises sliding shoes which act as its linear bearing on the friction bearing walls. A piston 7 is arranged on the piston rod 9 which moves linearly back and forth in a cylinder 5 comprising a cylinder housing 5*a*.

A pump unit 2 is provided on the drive unit 1. The pump unit 2 provides a working fluid chamber 23 adjoining each cylinder 5, working fluid 22, for example hydraulic oil, being provided in the working fluid chamber 23 which transmits the movement of the piston 7 to a diaphragm 6. In FIG. 1, the positions of the piston 7 and the diaphragm 6 to one another do not correspond to conventional operation. During conventional operation, the diaphragm 6 is arranged in the not depicted right extreme position instead of the depicted left extreme position at the depicted right extreme position of the piston 7. The diaphragm 6, together with a part of the diaphragm housing 6*a*, forms a working chamber 4. By means of check valves 13, the working chamber 4 is connected to a pressure pipe 17 and a suction line (not depicted in FIG. 1). The suction line is arranged below and connected to the suction valve housing 15.

A rotation of the crankshaft 18 causes the working fluid 22 in the working fluid chamber 23 to move back and forth, thus deflecting the diaphragm 6, 6' alternatingly to the right and to the left. A deflection to the left leads to a closing of the outlet check valve or pressure valve in a pressure valve housing 14 and suction of medium to be pumped through the opened inlet check valve or suction valve 15' in the suction valve housing 15. The subsequent displacement of the piston to the right, according to FIG. 1, leads to a closing of the inlet check valve and release of a volume of flow volume corresponding to the piston displacement or displaced piston volume through the now open outlet check valve while displacing the diaphragm to the right, relative to FIG. 1.

Figure 4:
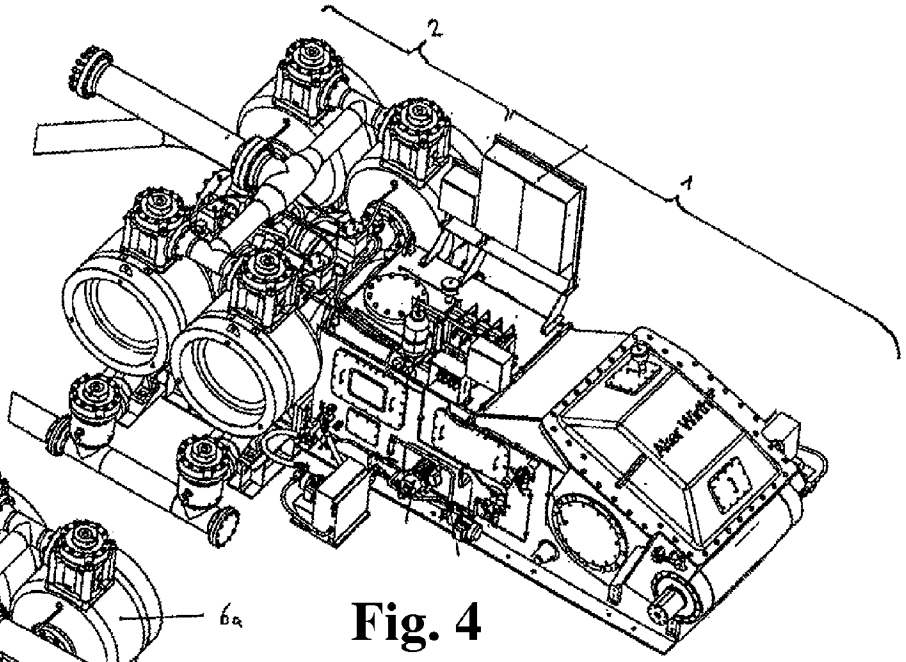
FIG. 4 shows a view as in FIG. 3 from a different direction.
Figure 3:
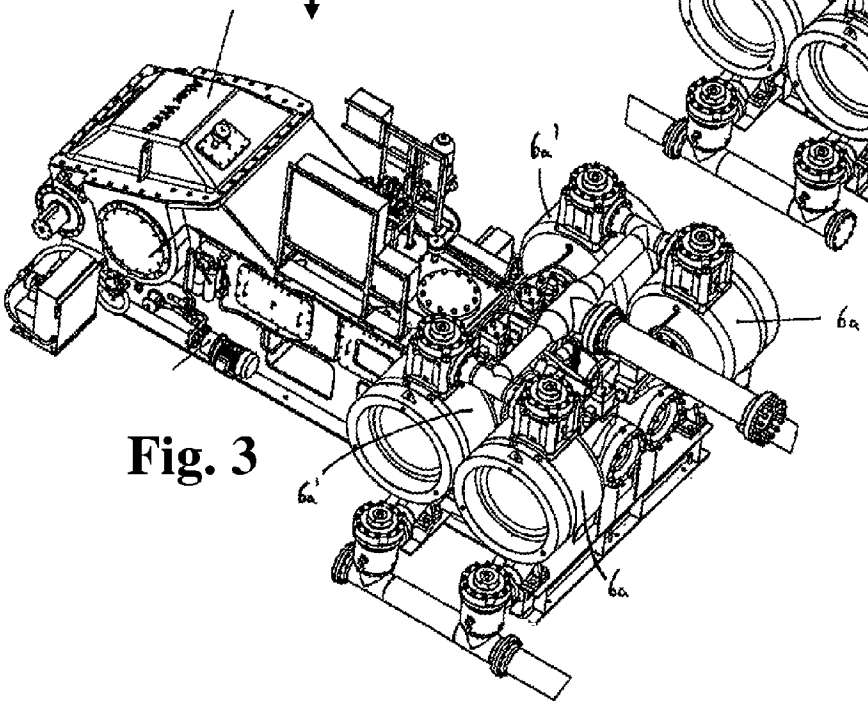
FIG. 3 shows a perspective depiction of a double-acting duplex pump described in the prior art.

FIGS. 3 and 4 show a duplex pump known from the prior art, i.e., a pump with two connecting rods, piston rods, pistons, and cylinders. It is double-acting. It has four diaphragm housings 6*a*, 6*a*' and is used particularly for bigger volume flows.

FIGS. 5 to 9 show the pump unit 2 of a positive displacement pump according to the present invention which is a piston diaphragm pump. The displacement elements 3, 3' are thus diaphragms 6, 6'. The depicted embodiment of the pump according to the present invention is, in its entirety, denoted with reference sign 100 (FIGS. 10 to 13). It can be seen that the depicted pump 100 according to the present invention is a triplet pump or triplex pump. There are three connecting rods 18*a* which are acting together with three pistons 7 moving inside three cylinders 5.

Figure 13:
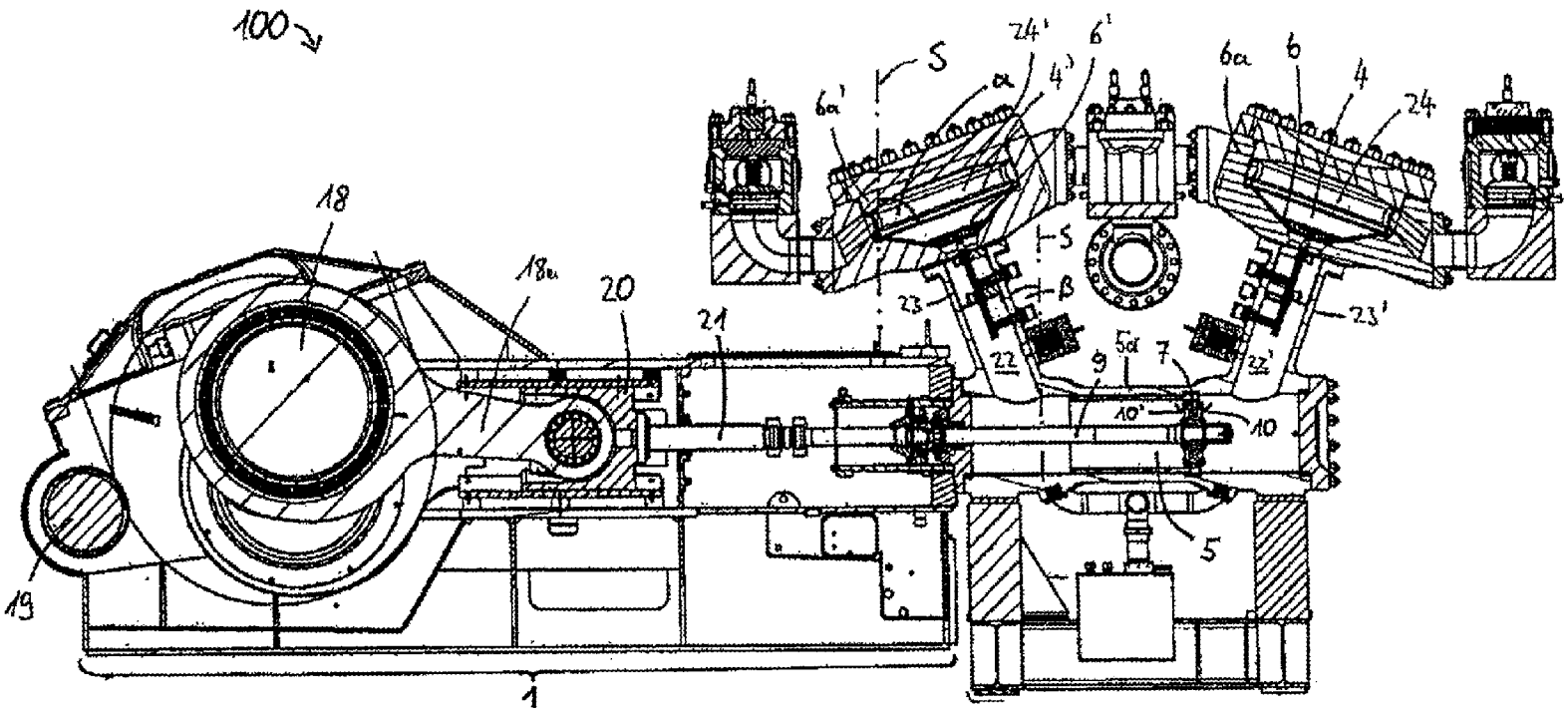
FIG. 13 shows a cross-sectional depiction of the positive displacement pump according to the present invention on a larger scale.

The drive unit 1 of the depicted pump 100 according to the present invention substantially corresponds to the drive unit 1 of the single-acting triplex pump known from the prior art (FIGS. 1 and 2). A comparison, particularly of FIGS. 1 and 13, shows that the previous piston 7 and the previous cylinder 5 (FIG. 1) now perform at least lead functions. On the right (relative to FIG. 1) of the previous piston, an extension of the piston rod 9 is arranged and the piston 7 is now attached to it. The piston 7 separates the cylinder 5 into a region which is connected to a working fluid chamber 23 tilted toward the drive unit 1, and a region which communicates with a working fluid chamber 23' tilted away from the drive unit 1. Working or transmission fluid 22, 22' is arranged in the working fluid chambers 23, 23' which, for example, can be hydraulic oil.

If the piston 7 moves to the right (relative to FIG. 13), it displaces the working fluid 22 in the right working fluid chamber 23' which presses the right diaphragm 6 into the right working chamber 4 (each relative to FIG. 13). Under conventional operating conditions, the diaphragm 6 depicted on the right is not arranged in its depicted lower extreme position but in its upper extreme position if the piston 7, as shown in FIG. 13, is in its right extreme position. If the piston 7 moves to the left, the working fluid 22' arranged in the right working fluid chamber 23' follows it and suctions the right diaphragm 6 downward. Simultaneously, the left surface 10' of the piston displaces the working fluid 22 arranged in the left working fluid chamber 23 which causes the left diaphragm 6' to be pushed upward. With either its movement to the right or its movement to the left, the piston 7 thus applies pressure to one of the two diaphragms 6, 6'.

Figures 5, 6, 7, 8, 9:
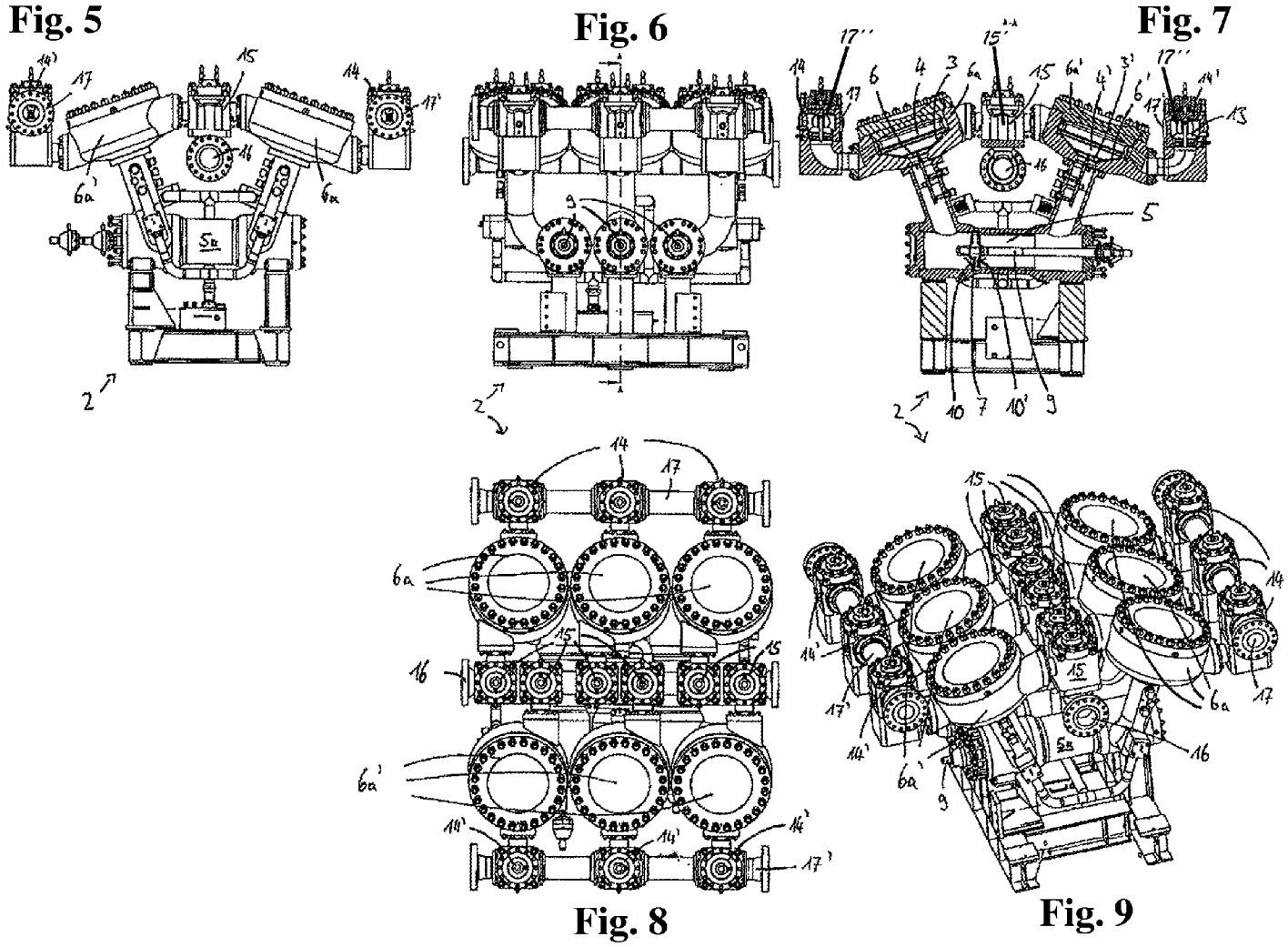
FIG. 5 shows a side view of a pump unit according to the present invention.
FIG. 6 shows a view of the drive unit on a pump according to the present invention.
FIG. 7 shows a cross-sectional depiction of the pump unit according to the present invention.
FIG. 8 shows a view from above onto the pump unit according to the present invention.
FIG. 9 shows a perspective depiction of the pump unit according to the present invention.
Figure 12:
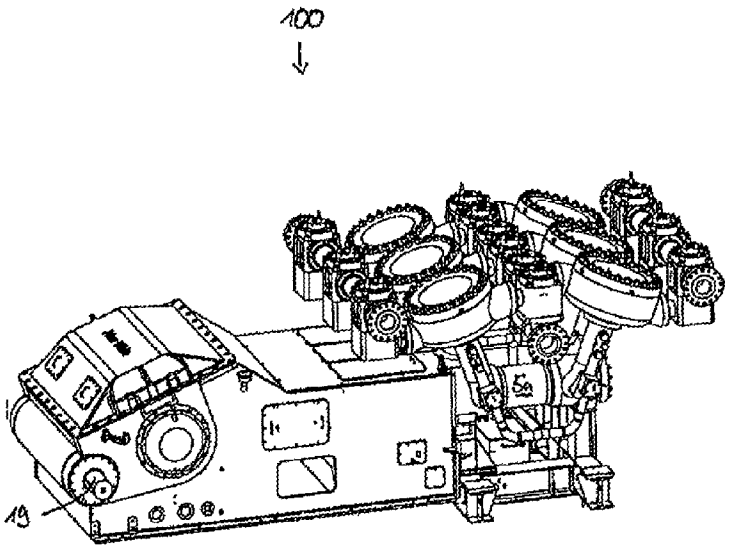
FIG. 12 shows a perspective depiction of the positive displacement pump according to the present invention.
Figure 10:
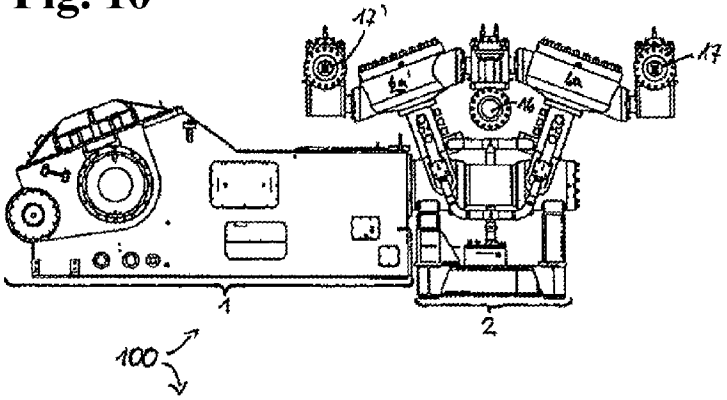
FIG. 10 shows a side view of the positive displacement pump according to the present invention.
Figure 11:
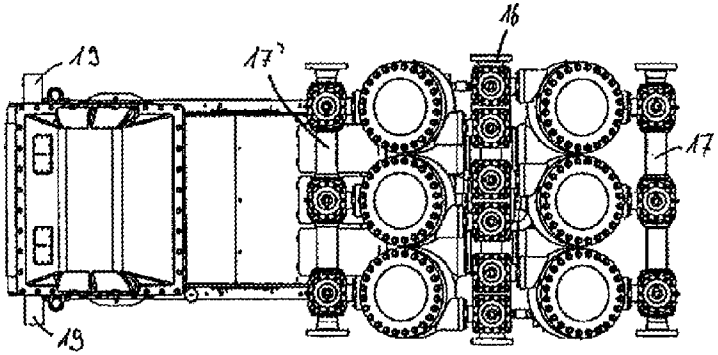
FIG. 11 shows a view from above onto the positive displacement pump according to the present invention.

The diaphragms, together with a part of the diaphragm housings 6*a*, 6*a*', each form a working chamber 4, 4'. As shown particularly in FIG. 7, the working chambers 4, 4' are each connected to a pressure pipe 17, 17' by means of a pressure valve 17" in a pressure valve housing 14, 14' and to a suction line 16 by means of a suction valve 15' in a suction valve housing 15. FIG. 9 shows that exactly one suction valve 15' and exactly one pressure valve 17" are provided per diaphragm 6. The suction valves 15' act on a single suction line 16 while the pressure valves 17" are allotted to two pressure pipes 17, 17'.

The specifications of the single-acting triplex pump shown in FIGS. 1 and 2 (TPM-2200 by Aker Wirth) can be as follows: Piston diameter 310 mm, piston stroke: 508 mm, volume flow rate (design normal) 351 $m^3$/h, maximum volume flow rate 385 $m^3$/h, theoretical output per crankshaft rotation: 115.0 l, volumetric efficiency: 0.94, normal stroke count: 54.1 $min^{-1}$, maximum stroke count: 59.3 $min^{-1}$, normal pumping pressure: 80.0 bar, maximum pumping pressure: 96.0 bar, gear ratio of the inlying toothed wheels ("internal gear ratio"): 3.8077, piston rod load at normal pumping pressure: 604 kN, piston rod load at maximum pumping pressure: 725 kN, bearing lifespan at operation with maximum load: 69,100 h, bearing lifespan at normal operation: 126,800 h, displaced piston volume: 38.3 l, required diaphragm type in liters: 60 l.

The specifications of the depicted embodiment of the positive displacement pump according to the present invention are as follows: Piston diameter 275 mm, piston stroke: 508 mm, volume flow rate (design normal) 351 $m^3$/h, maximum volume flow rate 385 $m^3$/h, theoretical output per crankshaft rotation: 173.4 l, volumetric efficiency: 0.94, normal stroke count: 35.9 $min^{-1}$, maximum stroke count: 39.4 $min^{-1}$, normal pumping pressure: 80.0 bar, maximum pumping pressure: 96.0 bar, gear ratio of the inlying toothed wheels ("internal gear ratio"): 3.8077, piston rod load at normal pumping pressure: 475 kN, piston rod load at maximum pumping pressure: 570 kN, bearing lifespan at operation with maximum load: 445,700 h, bearing lifespan at normal operation: 810,500 h, displaced piston volume front side: 30.2 l, displaced piston volume rear side: 27.6 l, required diaphragm type in liters: 47 l.

The following differences exist with regard to the diaphragm: The single-acting triplex pump shown in FIGS. 1 and 2 requires three diaphragms, the size of which is designed for 60 l, the operating hours of the diaphragm are set at 3,000, the number of diaphragm replacements per year (8,000 h) is 2.67.

By contrast, the depicted positive displacement pump according to the present invention requires six diaphragms, the size of which is designed for 47 l, the operating hours of the diaphragm are set at 4,500, in case of a possible new development of the diaphragms, up to 8,000 operating hours are expected, the number of diaphragm replacements per year is 1.78 and the number of expected diaphragm replacements per year is 1.

The following situation arises with regard to the valves: The single-acting triplex pump shown in FIG. 1 requires six valves with size API 13, with 1,200 operating hours. The average velocity of the valves is 1.72 and the number of valve replacements per year (8,000 h) is 6.67.

By contrast, the depicted embodiment of the positive displacement pump according to the present invention requires 12 valves, also size API 13, with 1,800 operating hours. The average velocity is 1.29, the expected operating hours, due to the reduced velocity, are 2,160, the valve replacements per year amount to 4.44 and the expected valve replacements per year are 3.7.

The following advantages of the depicted embodiment of the positive displacement pump according to the present invention can in particular be identified when compared to the conventional single-acting triplex pump shown in FIG. 1: Reduction of the piston rod load by more than 20%, reduced load on the crankshaft due to double action, reduction of the piston speed by 33%, increase of the lifespan of the bearings and all pump drive unit components up to the entire operating lifespan of 30 years, less wear and increased lifespan of the pump drive unit components by at least 25%, at least double the diaphragm lifespan, increased pump efficiency, a fundamentally possible, higher volume flow at lower piston rod load, lower maintenance costs due to fewer maintenance cycles per year, fewer production losses, and reduced net positive suction head (NPSHr) of the pump.

FIG. 13 also shows that the diaphragms 6, 6' are not perpendicular but tilted by an angle $\alpha$ from the perpendicular line S. The angle $\alpha$ can be between 1° and 90°, particularly 60° and 80°. In the depicted embodiment, it is approximately 70°. The working fluid chamber 23, 23' has a cylindrical shape in the region adjoining the diaphragm housing 6*a*, 6*a*'. The cylinder axis is perpendicular to the diaphragm (in its neutral position). The cylindrical region of the working fluid chamber 23, 23' is thus tilted at an angle $\beta$ from the perpendicular line. Said angle can span from 0° to 89°. In the depicted embodiment, it is approximately 20°. For reasons of symmetry, angles $\alpha$ and $\beta$ combined always add up to 90°.

The tilting of the diaphragms 6, 6', i.e., their tilt from the perpendicular line, which has inventive significance in itself, achieves several advantages. A space-saving arrangement of the diaphragm housings on the compactly parallel cylinders 5 is achieved which allows for the structure of a compact double-acting triplex pump with closely parallel cylinders. It furthermore results in a decrease of the hydraulic pressure component acting irregularly on the diaphragm when compared to a perpendicular diaphragm. This leads to an increased lifespan of the diaphragm. The impact of possible gas deposits in the medium to be pumped 24, 24' on the lifespan of the diaphragm, possibly caused or amplified by cavitation, is decreased. The measures and impacts of the tilting of the diaphragm shall be further explained with reference to FIGS. 14 and 15.

Figure 14:
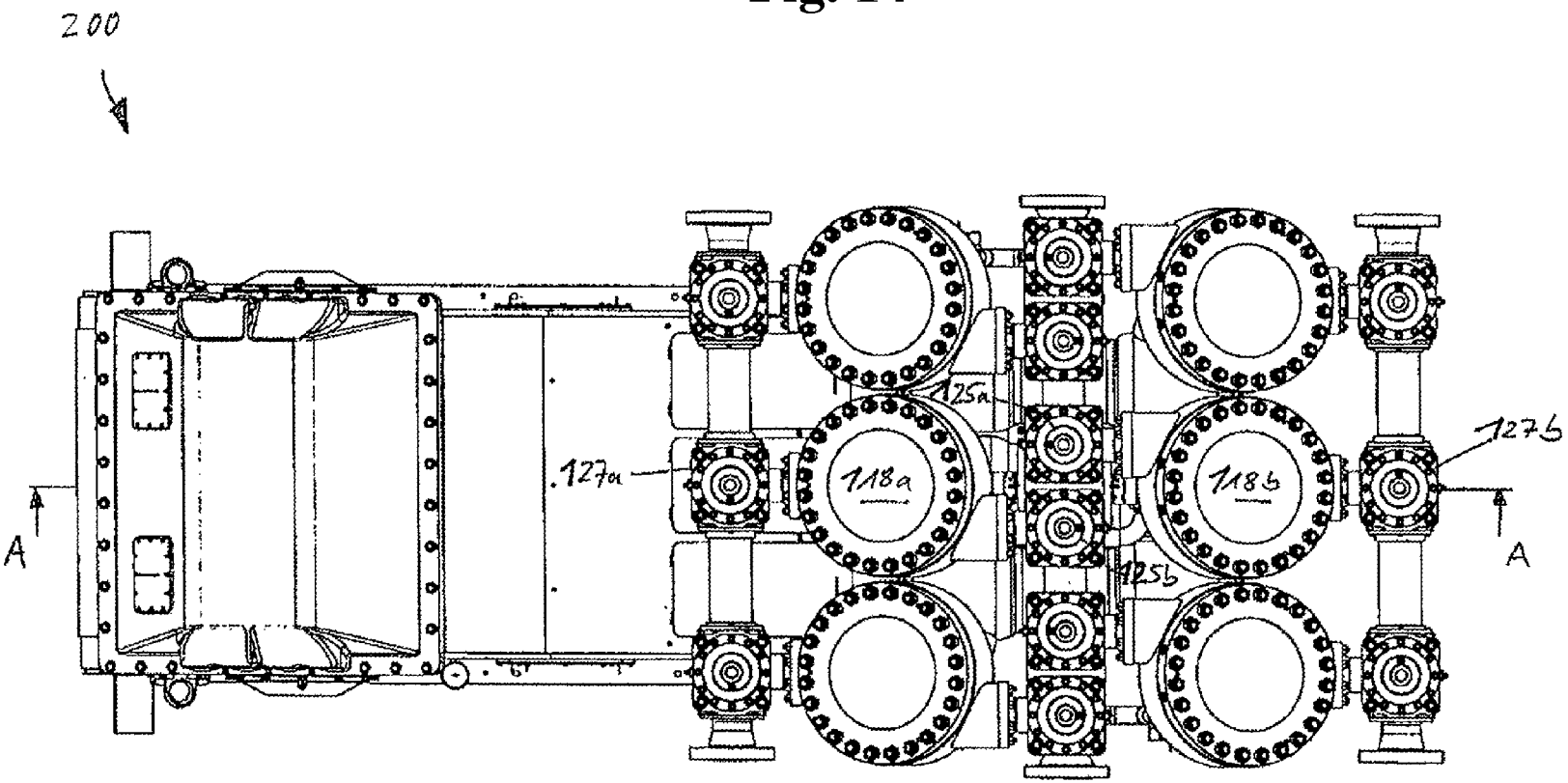
FIG. 14 shows a magnified depiction of FIG. 4.
Figure 15:
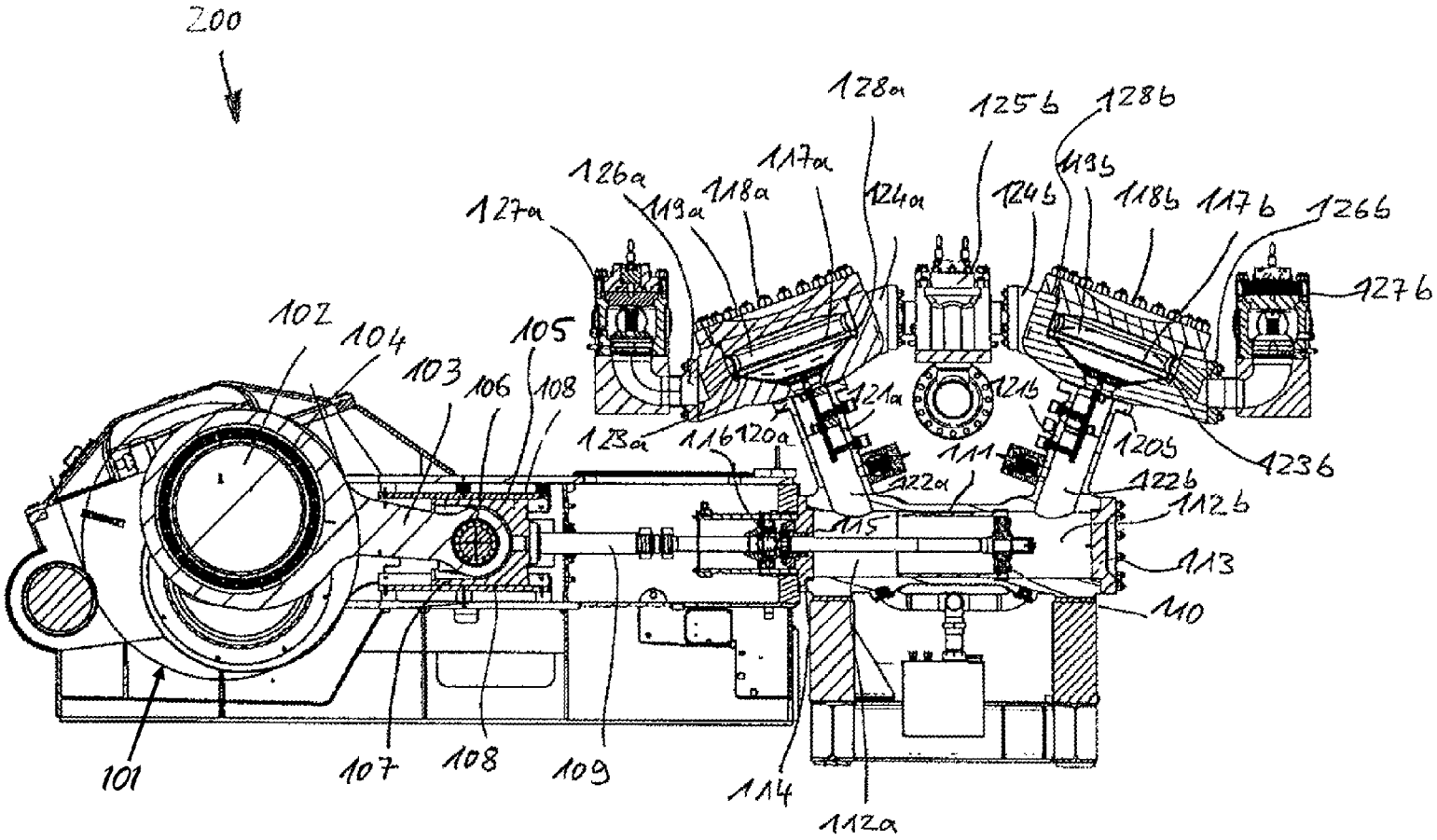
FIG. 15 shows section A-A in FIG. 14.

The piston diaphragm pump, in its entirety denoted with reference sign 200 in FIGS. 14 and 15 is (as can be seen in FIG. 14) once again designed as a three-piston diaphragm pump.

FIG. 15 shows a longitudinal section through the middle part of the pump. The two further parts of the pump are designed accordingly.

The depicted piston diaphragm pump 200 comprises a motor-driven crankshaft 101, on the middle crankpin 102 of which, a connecting rod 103 is mounted by means of a big end bearing 104. On the other end of the connecting rod 103, a crosshead 105 is mounted by means of a crosshead bearing 106. The crosshead comprises sliding shoes 107 which act as its linear bearing on the friction bearing walls 108.

A piston rod 109 is attached to one end of the crosshead 105. The other end of the piston rod 109 holds a piston 110 which is designed as double-acting piston and operates within a cylinder 111. FIG. 2 shows the right dead center.

The cylinder 111 is arranged within a working volume which is divided by the piston 110 into two working volumes 112*a*, 112*b*. The right end of the working volume 112*b* in FIG. 2 is closed with a lid 113. On the left end of the working volume 112*a*, another lid 114 is attached which is provided with a central opening 115 for passage of the piston rod 109. A sealing arrangement 116 is provided on the lid 114 which seals the piston rod 109 with respect to the lid 114 from leaking working liquid from the working volume 112.

The working liquid (not depicted in the drawing), which is frequently hydraulic oil, and is thus also called oil supply, fills the working volume 112*a*, 112*b* up to two diaphragms 117*a*, 117*b* which are depicted in FIG. 15 (relative to the dead center position of the piston 110 incorrectly) in their middle position. In reality, the diaphragm depicted on the left would be deflected downward on both sides of the double-acting piston 110 due to the substantial consistency of the working liquid volume, and the diaphragm 117 would be correspondingly deflected upward, as is qualitatively shown with the broken line in FIG. 15.

The diaphragms 117*a*, 117*b* are arranged in diaphragm housings 118*a*, 118*b* and separate diaphragm chambers 119*a*, 119*b* from the oil supply in the working volume 112*a*, 112*b*.

The diaphragm housings 118*a*, 118*b* are attached to flanges 120*a*, 120*b* of channel housings 121*a*, 121*b*. The channel housings 121*a*, 121*b* comprise channels 122*a*, 122*b* which form parts of the working volume 112*a*, 112*b*. The two channel housings 121*a*, 121*b*, which are designed to be substantially straight, each comprise an angle of approximately 20° with the perpendicular line such that the distance between the two channel housings 121*a*, 121*b* widens upwardly. The diaphragm housings 118*a*, 118*b*, in which the diaphragms 117*a*, 117*b* are clamped with their planar edge regions 123*a*, 123*b*, are attached to the flanges 120*a*, 120*b* so that the diaphragms 117*a*, 117*b* in their planar middle position extend perpendicularly to the longitudinal axis of the corresponding channel 122*a*, 122*b*. In the embodiment depicted in FIG. 15, the two diaphragms 117*a*, 117*b* are thus arranged at an angle of 70° from the perpendicular line.

Every diaphragm chamber comprises an inlet 124*a*, 124*b* each with a flange-mounted inlet check valve 125*a*, 125*b* (see FIG. 14).

On the sides opposite of the inlets 124*a*, 124*b*, the diaphragm chambers 119*a*, 119*b* comprise outlets 126*a*, 126*b* each with a flange-mounted outlet check valve 127*a*, 127*b*.

The rotary action of the crankshaft 101 causes the working liquid to be moved back and forth in the working liquid volume 112*a*, 112*b* and the diaphragms 117*a*, 117*b* to be moved back and forth between the extreme deflections depicted as broken line. Each downward deflection leads to a suctioning of slurry through the correspondingly opened inlet check valve. This pumping phase is also called suction stroke. The subsequent deflection of the piston leads to a closing of the previously opened inlet check valve and output of the volume of slurry, which corresponds to the displacement, through the now opened outlet check valve while the diaphragm is displaced in the upwardly curved extreme position, depicted as broken line in FIG. 15.

In order to be able to release gas (particularly air) which possibly accumulated in the region below a diaphragm in the working volume 112*a*, 112*b*, the two diaphragm housings are provided with venting valves (not depicted) in the highest edge region of the diaphragms 117*a*, 117*b*, denoted in the drawing with 128*a*, 128*b*.

The present invention is not limited to embodiments described herein; reference should be had to the appended claims.

LIST OF REFERENCE NUMERALS

100 Positive displacement pump
1 Drive unit
2 Pump unit
3, 3' Displacement elements
4, 4' Working chambers
5 Cylinder
5*a* Cylinder housing
6, 6' Diaphragms
6*a*, 6*a'* Diaphragm housings
7 Piston
8 blank
9 Piston rod
10, 10' Piston surfaces
11 Inlet
12 Outlet
13 Check valve
14, 14' Pressure valve housing
15 Suction valve housing
15' Suction valve
16 Suction line
17, 17' Pressure pipe
17" Pressure valve
18 Crankshaft
18*a* Connecting rod
19 Driveshaft
20 Crosshead
21 Crosshead rod
22, 22' Working or transmission fluid
23, 23' Working fluid chamber
24, 24' Medium to be pumped
S Perpendicular line
α, β Angles
200 Piston diaphragm pump
101 Crankshaft
102 Crankpin
103 Connecting rod
104 Big end bearing
105 Crosshead

106 Crosshead bearing
107 Sliding shoes
108 Friction bearing wall
109 Piston rod
110 Piston
111 Cylinder
112*a*, 112*b* Working volumes
113 Lid
114 Lid
115 Opening
116 Sealing arrangement
117*a*, 117*b* Diaphragms
118*a*, 118*b* Diaphragm housings
119*a*, 119*b* Diaphragm chambers
120*a*, 120*b* Flanges
121*a*, 121*b* Channel housings
122*a*, 122*b* Channels
123*a*, 123*b* Edge regions
124*a*, 124*b* Inlets
125*a*, 125*b* Inlet check valves
126*a*, 126*b* Outlets
127*a*, 127*b* Outlet check valves
128*a*, 128*b* Regions

What is claimed is:

1. An operating method for a positive displacement pump provided as a piston diaphragm pump, the operating method comprising:

providing a positive displacement pump configured to be double-acting, the positive displacement pump comprising:

a drive unit, and a pump unit comprising:

a plurality of working chambers, at least three cylinders which each comprise a piston, a plurality of displacement elements comprising diaphragms configured to be actuated by the pistons, the diaphragms each comprising a first side and a second side, a diaphragm chamber bounded by the second side, the diaphragm chamber being separated from a working volume containing the working liquid by the diaphragm, and a channel extending upward at an angle of from 1° to 80° from each of the at least three cylinders when viewed from a side view perpendicular to the at least three cylinders when arranged horizontally, the working volume being formed in part by the channel, providing a working liquid on the first side of each of the diaphragms;

providing a diaphragm stroke via the working liquid; and conducting a medium to be pumped through the diaphragm chamber via the diaphragm stroke;

wherein, the diaphragm stroke is provided at a diaphragm position different from a vertical position of the diaphragm.

2. The operating method as recited in claim 1, wherein the diaphragm stroke is provided at a diaphragm position which is 45° to 80° different from a vertical position of the diaphragm.

3. The operating method as recited in claim 2, wherein the diaphragm stroke is provided at a diaphragm position which is approximately 70° different from a vertical position of the diaphragm.

4. A positive displacement pump designed as a piston diaphragm pump, the positive displacement pump comprising:

a diaphragm arranged in a non-vertical position;

a diaphragm chamber through which a medium to be pumped is conducted;

a cylinder;

a piston arranged in the cylinder and configured to perform an oscillating movement therein, the oscillating movement of the piston being transmittable to the diaphragm via a working fluid; and a channel extending upward at an angle of from 1° to 80° from the cylinder when viewed from a side view perpendicular to the cylinder when arranged horizontally, wherein, the diaphragm separates a working volume containing the working liquid from the diaphragm chamber, the working volume is formed in part by the channel.

5. The piston diaphragm pump as recited in claim 4, wherein the non-vertical position of the diaphragm is 45° to 80° different from a vertical position of the diaphragm.

6. The piston diaphragm pump as recited in claim 4, wherein the non-vertical position of the diaphragm is approximately 70° different from a vertical position of the diaphragm.

7. The piston diaphragm pump as recited in claim 4, wherein a longitudinal axis of the cylinder is arranged so as to be approximately horizontal.

8. The piston diaphragm pump as recited in claim 4, wherein the channel comprises a channel housing, and further comprising a diaphragm housing configured to receive the diaphragm, and a flange arranged in the channel housing, the flange being arranged to be approximately perpendicular to a longitudinal axis of the channel, and the diaphragm housing being attached to the flange.

9. The piston diaphragm pump as recited in claim 8, wherein the diaphragm comprises an edge region configured to be clamped in the diaphragm housing approximately in a plane.

10. The piston diaphragm pump as recited in claim 9, wherein the plane is arranged at an angle which is 45° to 80° different from a vertical position of the diaphragm.

11. The piston diaphragm pump as recited in claim 9, wherein the diaphragm further comprises a lateral edge region, and the plane is arranged at an angle so that a highest point of the working volume is formed on the lateral edge region.

12. The piston diaphragm pump as recited in claim 9, wherein the diaphragm comprises a shape which is approximately circular.

* * * * *